US008039749B2

(12) United States Patent
Okano et al.

(10) Patent No.: US 8,039,749 B2
(45) Date of Patent: Oct. 18, 2011

(54) DIFFERENTIAL TRANSMISSION SIGNAL CABLE AND COMPOSITE CABLE CONTAINING THE SAME

(75) Inventors: Satoshi Okano, Tochigi (JP); Atsushi Tsujino, Tochigi (JP); Shinpei Takeda, Tokyo (JP)

(73) Assignees: Sumitomo Electric Industries, Ltd., Osaka (JP); Japan Aviation Electronics Industry, Limited, Tokyo (JP)

( * ) Notice: Subject to any disclaimer, the term of this patent is extended or adjusted under 35 U.S.C. 154(b) by 110 days.

(21) Appl. No.: 12/533,820

(22) Filed: Jul. 31, 2009

(65) Prior Publication Data

US 2010/0025072 A1 Feb. 4, 2010

(30) Foreign Application Priority Data

Jul. 31, 2008 (JP) ..... P2008-197695

(51) Int. Cl.
*H01B 11/02* (2006.01)

(52) U.S. Cl. ..... 174/113 R

(58) Field of Classification Search ..... 174/113 R, 174/117 F

See application file for complete search history.

(56) References Cited

U.S. PATENT DOCUMENTS

| | | | | |
|---|---|---|---|---|
| 3,794,752 | A * | 2/1974 | Bunish et al. | 174/115 |
| 4,096,346 | A * | 6/1978 | Stine et al. | 174/36 |
| 5,956,445 | A * | 9/1999 | Deitz et al. | 385/100 |
| 6,010,788 | A * | 1/2000 | Kebabjian et al. | 428/381 |
| 6,630,624 | B2 * | 10/2003 | Tsao et al. | 174/36 |
| 6,677,518 | B2 * | 1/2004 | Hirakawa et al. | 174/36 |

FOREIGN PATENT DOCUMENTS

| | | | |
|---|---|---|---|
| JP | 2-44610 | * | 2/1990 |
| JP | 9-213143 | | 8/1997 |
| JP | 2002-135938 | | 5/2002 |

* cited by examiner

*Primary Examiner* — Chau Nguyen

(74) *Attorney, Agent, or Firm* — McDermott Will & Emery LLP

(57) ABSTRACT

A differential transmission signal cable is provided. The differential transmission signal cable includes one pair of signal wires including a central conductor covered by an insulating layer, a drain wire arrayed along the signal wires, and an outer conductor for covering the signal wires and the drain wire. The drain wire is covered by a covering film made of a semi-conductive material having flexibility and containing an electrically conductive filler.

4 Claims, 3 Drawing Sheets

DIFFERENTIAL TRANSMISSION SIGNAL CABLE AND COMPOSITE CABLE CONTAINING THE SAME

This application claims priority from Japanese Patent Application No. 2008-197695, filed on Jul. 31, 2008, the entire contents of which are hereby incorporated by reference.

FIELD OF THE INVENTION

The present invention is related to a differential transmission signal cable and a composite cable containing the differential transmission signal cable which is employed in order to transmit digital data, and the like.

DESCRIPTION OF RELATED ART

As differential transmission signal cables for transmitting digital data and the like, JP-A-2002-135938 discloses a cable which has been constructed of two differential transmission signal wires, a drain wire, and a shield cover which covers these differential transmission signal wires and drain wire.

JP-A-9-213143 discloses a transmission wire equipped with a drain wire. In order to automatically, or semi-automatically connect a cable terminal to a wire terminal, the drain wire has a sectional area similar to that of a signal wire, in which a drain wire-purpose stranded metal conductor is arranged at a center of a jacket made of a semi-conductive material. The jacket of the drain wire of the above-described transmission wire is constituted of a suitable semi-conductive material such as a polymer with a filler of electrically conductive or semi-conductive material such as metallic powder or carbon black.

On the other hand, as to a differential transmission signal cable equipped with a drain wire whose metal is exposed, there are some possibilities that when bending force is applied to the differential transmission signal cable, the drain wire is depressed against the signal wire at a bent portion of the differential transmission signal cable, an insulating layer of the signal wire is damaged by the depressed drain wire, so that a center conductor may be shortcircuited to the drain wire. Also, in order to connect the differential transmission signal cable to a connector, even when the drain wire is intersected with the signal wire at the cable terminal, the drain wire is depressed to the signal wire, and thus, the signal wire is damaged, so that the center conductor is shortcircuited with the drain wire.

In JP-A-9-213143, although the stranded metal conductor is covered by the jacket made of the semi-conductive material, the transmission cable has such a purpose that since the sectional plane of the drain wire is made equal to that of the signal line, the cable terminal can be automatically, or semi-automatically connected to the wire terminal. However, the transmission cable of JP-A-9-213143 has no specific technical idea capable of preventing damages of the signal wire, which are caused by the depressed drain wire.

SUMMARY OF INVENTION

Illustrative aspects of the present invention provide a differential transmission signal cable having high reliability in which a signal wire is not damaged by a drain wire, and a composite cable equipped with the above-explained differential transmission signal cable.

According to a first aspect of the invention, a differential transmission signal cable is provided with one pair of signal wires including a central conductor covered by an insulating layer, a drain wire arranged along the signal wires, and an outer conductor for covering the signal wires and the drain wire. The drain wire is covered by a covering film made of a semi-conductive material having flexibility and containing an electrically conductive filler.

According to a second aspect of the invention, a circumference of the outer conductor may be covered by a jacket layer.

According to a third aspect of the invention, a composite cable of the present invention may include a plurality of the differential transmission signal cables of the present invention.

DETAILED DESCRIPTION OF EXEMPLARY EMBODIMENT

A description regarding an exemplary embodiment of a differential transmission signal cable and a composite cable containing the differential transmission signal cable will be made referring to FIGS. 1 to 5.

Figure 1:
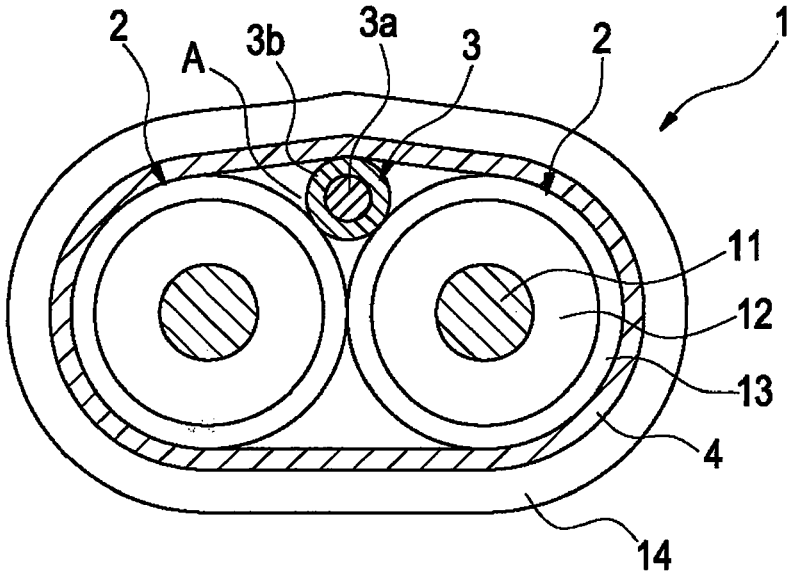
FIG. 1 is a sectional view for showing a differential transmission signal cable according to an exemplary embodiment of the present invention.
Figure 2:
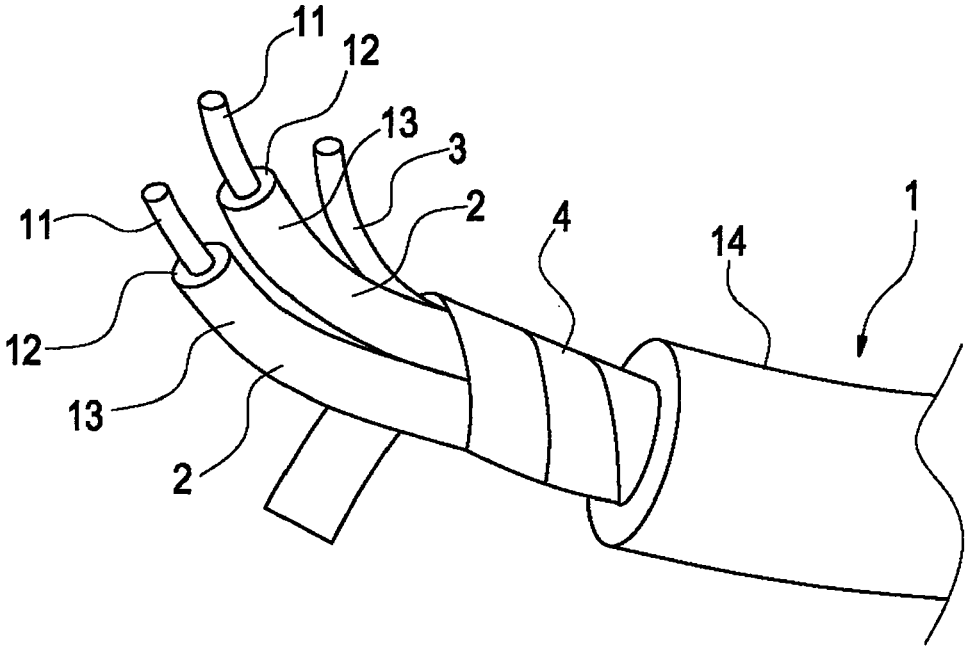
FIG. 2 is a perspective view for representing a cable terminal of the differential transmission signal cable of the exemplary embodiment.

As shown in FIGS. 1 and 2, a differential transmission signal cable 1 of the exemplary embodiment is provided with one pair of signal wires 2, a drain wire 3 arrayed along the signal wires 2, and an outer conductor 4 which covers the signal wires 2 and the drain wire 3.

The respective signal wires 2 include a central conductor 11, dielectric layer (insulating layer) 12 and a skin layer 13. In the signal wire 2, the central conductor 11 is covered by the dielectric layer 12, and the skin layer 13 is provided on an outer circumference of the dielectric layer 12. Then, two signal wires 2 are arranged in a parallel manner such that the signal wires 2 are contacted to each other. A valley portion "A" is formed on one side portion at contact portions of the signal wires 2. The drain wire 3 is arrayed in the valley portion "A" along a longitudinal direction thereof.

Then, the outer conductor 4 made of a metal foil tape is wound on the outer circumferences of the signal wires 2 and the drain wire 3, while the above-described arranging structure is maintained. In addition, an outer side of the outer conductor 4 is covered by a jacket layer 14.

Although the signal wires 2 may be arrayed parallel to each other in a straight line manner in the differential transmission signal cable 1, the differential transmission signal cable 1 may be alternatively realized by a twist type transmission cable in which signal wires are twisted with each other. In the case that the differential transmission signal cable 1 is made into a twist type, the drain wire 3 is twisted in combination with the signal wires 2. In such a case that the drain wire 3 is twisted in combination with the signal wires 2, there is a higher risk that the drain wire 3 is depressed against the signal wires 2, so that the insulating layers of the signal wires 2 may be damaged, as compared with such a case that the signal wires 2 are arrayed parallel to each other.

There are some cases that the signal wires 2 have no skin layer 13.

As the central conductor 11 which constructs the signal wires 2, for example, either a stranded wire or a single wire may be used. The stranded wire is manufactured by stranding, or twisting 7 pieces of element wires. As the central conductor 11, wires whose outer diameters are selected from 0.16 mm (equivalent to AWG 32) to 0.58 mm (equivalent to AWG 24) may be used. As the central conductor 11, an annealed copper wire and a copper alloy may be utilized, while these wires plated by either tin or silver may be used. The dielectric layer 12 is manufactured by covering an outer circumference of the central conductor 11 with polyolefin, polyester, polyvinyl chloride, fluorocarbon polymers, and the like. Alternatively, foamed polyolefin may be employed as the dielectric layer 12. The skin layer 13 is formed by the same resin as that used for the dielectric layer 12, while the skin layer 13 covers the outer plane of the dielectric layer 12. Both the skin layer 13 and the dielectric 12 may be manufactured by the same resin. While thicknesses of both the dielectric layer 12 and the skin layer 13 are determined based on required electrostatic capacities, a total thickness of the dielectric layer 12 and the skin layer 13 may be defined approximately from 0.1 mm to 0.5 mm.

The outer conductor 4 is formed by winding a metal tape, or the like on the dielectric layer 12 and the skin layer 13 in a spiral form. The metal tape, or the like may be alternatively wound on dielectric layer 12 and the skin layer 13 in such a manner that the metal tape is longitudinally positioned thereon so as to form the outer conductor 4. The metal tape is such a tape that a metal foil is adhered onto a resin tape such as PET, while a copper foil, or an aluminium foil may be used as the metal foil. A thickness of the metal tape may be selected to be approximately 0.01 mm to 0.1 mm. A mechanical strength of the jacket layer 14 may be increased so as to protect both the outer conductor 4 and the interior structural components thereof. Alternatively, the above-described jacket layer 14 may be eliminated from the differential transmission signal cable 1, depending on an utilization field. The jacket layer 14 may be formed by polyolefin, polyester, polyvinyl chloride, fluorocarbon polymers, and the like, while a thickness of the jacket layer 14 may be selected to be 0.1 mm to 1 mm. For instance, the thickness of the jacket layer 14 may be set to 0.25 mm. In such a utilization field that noncombustibilities are required for the differential transmission signal cable 1, noncombustible resins may be employed. In view of reducing loads given to environments, polyolefin-series resins which do not contain halogen, polyurethane-series resins, copolymers such as EVA and EEA, and the like may be utilized.

Figure 3:
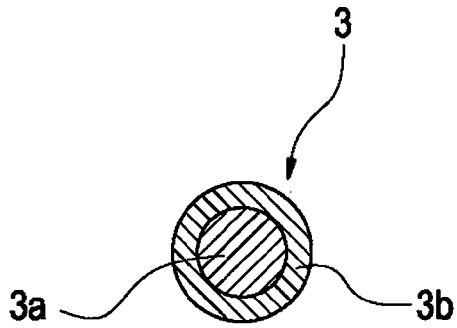
FIG. 3 is a sectional view for indicating a drain wire which constructs the differential transmission signal cable.

The drain wire 3 is made of a stranded wire by stranding 7 pieces of element wires, while a circumference of the drain wire 3 is covered by a covering film 3*b* as shown in FIG. 3. Although a thickness of the drain wire 3 may be determined based on a design of a connector, if a thickness of the drain wire 3 is extremely different from the thickness of the central conductor 11, then a dimension of a wire terminal of the drain wire 3 is different from a dimension of the central conductor 11. Accordingly, the thickness of the drain wire 3 may be substantially equal to that of the central conductor 11. While a copper alloy may be used in the drain wire 3, such a copper alloy plated by tin, silver, or the like may be employed. The drain wire 3 may be alternatively manufactured by a single wire.

A semi-conductive material having flexibility and containing an electrically conductive filler is employed in the covering film 3*b*. Although the above-explained semi-conductive material has an electrically conductive property, the semi-conductive material corresponds to such a material that the electrically conductive property thereof is deteriorated as compared with electrically conductive properties of a metal and carbon. The semi-conductive material implies such a material capable of being electrically conducted to the outer conductor 4. Secant modulus of elasticity can be an index of flexibility. Since secant modulus of elasticity of a soft resin which constructs the dielectric layer 12 of the signal wire 2 is equal to 100 MPa to 600 MPa, it is preferable that the secant modulus of elasticity of the semi-conductive material which constructs the covering film 3*b* is nearly equal to the above-described numeral values. A difference between the secant modulus of elasticity of the resin and the secant modulus of elasticity of the semi-conductive material may be defined within 100 MPa. If the difference between the secant modulus of elasticity of the semi-conductive material and the secant modulus of elasticity of the resin which constructs the dielectric layer 12 is present within the above-described range, then it is possible to regard that both the above-described materials are equivalent to each other.

As the semi-conductive material, such a material may be employed that an electrically conductive filler and a small amount (namely, smaller than, or equal to several weight %) of smoothening agent are kneaded in a resin. As to the electrically conductive filler, carbon black (powder) and metal powder are utilizable. If 25, or less parts by weight of carbon black is employed with respect to 100 parts by weight of the resin, there are some possibilities that an electric conductivity cannot be achieved, resulting in an insufficient electrically conductive property. However, if the amount of carbon black exceeds 75 parts by weight with respect to 100 parts by weight of the resin, the carbon black can be hardly kneaded in the resin, and also, can be hardly extruded under stable condition. Accordingly, an amount of carbon black which is mixed with 100 parts by weight of the resin may be selected to be within a range from 25 parts by weight to 75 parts by weight.

As resins to be employed, low density polyethylene (LDPE), polypropylene (PP), polyester elastomer, polyphenylene ether (PPE), or a mixture made by mixing the above-explained chemical products with each other may be employed.

Then, the semi-conductive material is extrude-molded with respect to the stranded wire 3*a*, so that such a drain wire 3 that the circumference of the stranded wire 3*a* is covered by the covering film 3*b* is obtained.

Figure 4:
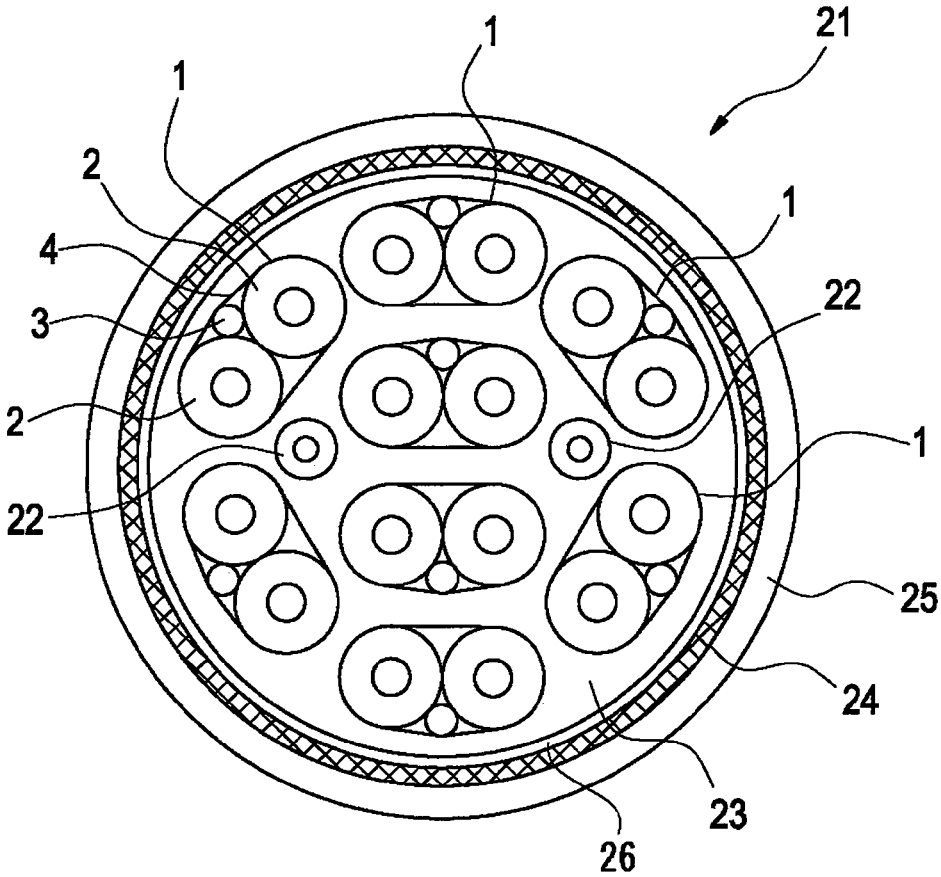
FIG. 4 is a sectional view for showing a composite cable according to another exemplary embodiment, which contains plural pieces of differential transmission signal cables.

Although the differential transmission signal cable 1 according to the exemplary embodiment may be used in the form of a single cable, as shown in FIG. 4, plural sets of the differential transmission signal cables 1 may be combined with each other as a composite cable 21.

The composite cable 21 shown in FIG. 4 includes plural pieces of the differential transmission signal cables 1 and other cables 22. The plural differential transmission signal cables 1 and other cables 22 are bundled in combination with yarn 23 by winding a tape 26, the outer circumference thereof is covered by a sheath 25 via a braided shield 24.

Figure 5:
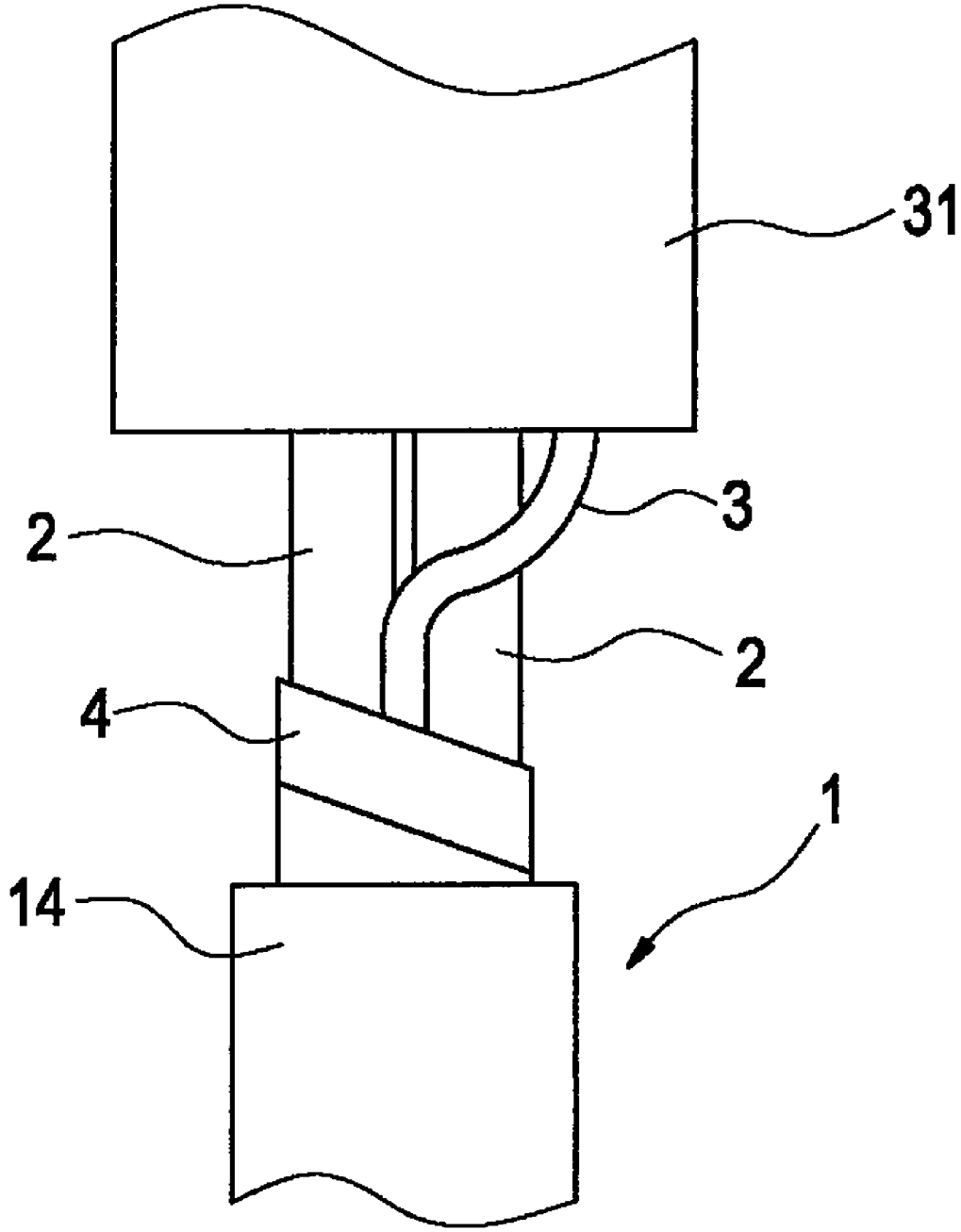
FIG. 5 is a plan view for representing a connection portion of a cable terminal of the differential transmission signal cable with respect to a connector.

When a cable terminal is connected to a connector 31, as shown in FIG. 5, there are some cases that the drain wire 3 is turned around outer side of the signal wire 2 so as to be connected to the connector 31. In this case, the drain wire 3 is brought into such a state that the drain wire 3 crosses over the signal wire 2 and are arranged laterally to the signal wire 2. Then, in this case, there are some possibilities that the drain wire 3 is depressed against the signal wire 2.

Moreover, when bending force is applied to the differential transmission signal cable 1, the drain wire 3 is brought into such a state that the drain wire 3 may be depressed against the signal wire 2 at the bending portion thereof.

In accordance with the exemplary embodiment, since the drain wire 3 is covered by the covering film 3*b* made of the semi-conductive material having the flexibility, which has contained carbon, even when the drain wire 3 is depressed against the signal wire 2, it is possible to avoid such a problem that the signal wire 2 may be damaged. Furthermore, such a high reliability that the central conductor 11 is not shortcircuited with the drain wire 3 can be maintained. Also, since the covering film 3*b* of the drain wire 3 which constitutes the earth wire is made of the semi-conductive material, a superior electrically conductive condition between the outer conductor 4 and the covering film 3*b* can also be secured.

EXEMPLE

A test for checking whether or not an adverse influence was given was carried out under such a condition that a drain wire without a covering film and another drain wire having the covering film were depressed against a single wire, respectively. Under such a condition that a buzzer was connected to one terminal of the signal wire and one terminal of the drain wire, the drain wire was positioned over the signal wire in such a manner that the drain wire was intersected perpendicular to the signal wire, and the drain wire was depressed against the signal wire, and thereafter, such a depression force was measured when the buzzer sounded because the drain wire broke through both a skin layer and a dielectric layer of the signal wire and, thereby become shortcircuited with a central conductor.

As to a central conductor which constitutes a signal wire, a stranded wire was employed by stranding 7 pieces of tin-plated annealed copper wires, whose diameter was 0.30 mm (namely, AWG 30). A dielectric layer was manufactured by a polyethylene layer having a thickness of 0.25 mm. While the polyethylene layer was made in a double-layer structure, a pigment was mixed into the skin layer provided outside the polyethylene layer in order that the signal wires can be distinguished from each other. As to drain wires which were used, a stranded wire was employed by stranding 7 pieces of tin-plated annealed copper wires, whose diameter was 0.30 mm (namely, AWG 30). A drain wire made of only the stranded wire was refereed to as a "drain wire without a covering film", whereas another drain wire covered by a semi-conductive material having a thickness of 0.15 mm was referred to as a "drain wire having a covering film." As to the semi-conductive material, such a material was employed which was manufactured by kneading 100 parts by weight of low density polyethylene, 55 parts by weight of carbon black, and 0.5 parts by weight of a smoothening agent (stearic acid zinc) with each other. The secant modulus of elasticity of the semi-conductive material was 148.5 MPa. The secant modulus of elasticity of polyethylene which comprises the dielectric layer of the signal wire was 152.6 MPa. That is, the secant modulus of elasticity of the semi-conductive material was approximated to the secant modulus of elasticity of the dielectric layer of the signal wire. The difference between the secant modulus of elasticity of the semi-conductive material and that of the dielectric layer of the signal wire was only several MPa.

As a result, depression force exerted in the drain wire without the covering film was 239 N, whereas depression force exerted in the drain wire having the covering film was 1028 N. In accordance with the differential transmission signal cable of the present invention which is equipped with the drain wire covered with the covering film made of the semi-conductive material, durability with respect to depression force and the like could be increased approximately 4, or higher times than that of the conventional differential transmission signal cable. If depression force is nearly equal to 239 N, then there is such a risk that a drain cable may break through an insulating layer of a signal wire when a cable is used. However, in the differential transmission signal cable of the present invention, the insulating layer of the signal wire can be endured up to the depression force of 1028 N. As a result, there is no such a risk that the drain wire may break through the insulating layer of the signal wire while the differential transmission signal cable is utilized, so that an occurrence of a short-circuit between the central conductor and the drain wire can be avoided.

While the present inventive concept has been shown and described with reference to certain exemplary embodiments thereof, it will be understood by those skilled in the art that various changes in form and details may be made therein without departing from the spirit and scope of the invention as defined by the appended claims.

What is claimed is:

1. A differential transmission signal cable comprising;

one pair of signal wires including a central conductor covered by an insulating layer;

a drain wire arranged along said signal wires; and an outer conductor for covering said signal wires and said drain wire, wherein:

said drain wire is covered by a covering film made of a semi-conductive material having flexibility and containing an electrically conductive filler, an outer diameter of said covering film for covering said drain wire is smaller than a diameter of each of said signal wires, said semi-conductive material is made of such a material that the electrically conductive filler and a smoothening agent are kneaded in a resin, the smoothening agent being less than or equal to several weight % with respect to the resin, and secant modulus of said semi-conductive material is equal to 100 MPa to 600 MPa.

2. The differential signal transmission cable according to claim 1, wherein a circumference of said outer conductor is covered by a jacket layer.

3. A composite cable comprising:

a plurality of the differential transmission signal cables recited in claim 1.

4. A composite cable comprising:

a plurality of the differential transmission signal cables recited in claim 2.

* * * * *